US006524180B1

(12) United States Patent
Simms et al.

(10) Patent No.: US 6,524,180 B1
(45) Date of Patent: Feb. 25, 2003

(54) ADJUSTABLE DUCT ASSEMBLY FOR FUME AND DUST REMOVAL

(76) Inventors: Maury Simms, 31 rue St-Jacques, 2nd Floor, Montreal, Quebec (CA), H2Y 1K9; Robin Boudreault, 31 rue St-Jacques, 2nd Floor, Montreal, Quebec (CA), H2Y 1K9; Marco Finauri, 31 rue St-Jacques, 2nd Floor, Montreal, Quebec (CA), H2Y 1K9

( * ) Notice: Subject to any disclaimer, the term of this patent is extended or adjusted under 35 U.S.C. 154(b) by 0 days.

(21) Appl. No.: 10/078,609

(22) Filed: Feb. 19, 2002

(51) Int. Cl.[7] ..... B08B 15/02

(52) U.S. Cl. ..... 454/65; 285/184

(58) Field of Search ..... 454/65, 63, 64, 454/67; 285/184, 302

(56) References Cited

U.S. PATENT DOCUMENTS

| | | | | | |
|---|---|---|---|---|---|
| 504,511 | A | * | 9/1893 | Anderson | 104/52 |
| 3,941,041 | A | * | 3/1976 | Sprout | 104/52 |
| 4,086,847 | A | * | 5/1978 | Overmyer | 104/52 |

* cited by examiner

*Primary Examiner*—Derek Boles
(74) *Attorney, Agent, or Firm*—Webb Ziesenheim Logsdon Orkin & Hanson, P.C.

(57) ABSTRACT

An adjustable duct assembly for the collection of fumes, dust and the like comprises two duct sections pivotally connected end to end and to a base by an external duct support system. The duct sections are retained in a selected position without the need for any friction fittings by a combination of a counterbalance arm extending from the duct support of a lower or outer duct section beyond the pivot point of the elongate arms, to counterbalance the lower or outer arms, and a retraction or tension-applying arm which holds the inner duct section in position.

14 Claims, 7 Drawing Sheets

18
10
270
16
280
260
20
12
56

ADJUSTABLE DUCT ASSEMBLY FOR FUME AND DUST REMOVAL

FIELD OF INVENTION

This invention relates to the collection and removal of fumes, dust and similar material, from a workplace and particularly, to a duct assembly which is controllably movable.

BACKGROUND OF THE INVENTION

The collection and removal of unwanted material, such as noxious fumes, dust and the like from workplaces such as factories, laboratories etc., can be obtained by the use of ducting having a collecting valve capable of being positioned adjacent to a source of unwanted material, the ducting connected to an abstraction system. Some of the uses of such removal devices include localized sources of fumes or dust such as welding operations, grinding machines, laboratory operations which can produce fumes from chemical reactions, and surgical operations. Such devices typically comprise a duct assembly having a collecting mouth or inlet at one end, and a connection to an abstraction fan at the other a filter or other purification means may be associated with the device. The duct assembly has some flexibility so that the collecting mouth or inlet can be stationed at any desired position. The assembly usually needs to be periodically repositioned and some form of support arrangement is required to retain the assembly in any given orientation and to permit easy movement and repositioning. Once repositioned the assembly should retain the new orientation and not be subject to undesirable movement. The mouth or inlet is normally movable in any direction in a plane and also movable in and out of such plane.

Various arrangements exist providing an adjustable assembly, including the provision of internal or external jointed frames which support the duct. Various devices such as lifting or position-balancing means, such as springs and other devices can be used, together with frictional means at joints.

Canadian Patent number 973,012 (Nederman) discloses a folding duct assembly having an internal duct support extending substantially the length of the duct. The duct support comprises a jointed arm having spring counterbalances to counter the weight of the duct. The joints of the duct support incorporate friction pads to retain the duct in a desired position. Jointed duct support structures are also shown in U.S. Pat. No. 5,527,217 (Engstrom) and U.S. Pat. No. 4,860,644 (Kohl et al). In the Kohl et al device, the joints incorporate friction pads to restrict their mobility, while the joints in Engstrom are linked to a retainer wire that in turn is held in place by a friction fit.

It is desirable, and in most cases essential, that there is provided means for holding the duct assembly in position during use, while still permitting easy movement to a new position. These conflicting requirements are difficult to satisfy with friction type joints. Wear at the joints will interfere with acceptable operation and regular adjustment will be required. If the support structure or frame is housed within the ducts of the assembly, such adjustment becomes very difficult. Also, the action of the friction joints can be adversely affected by the material being extracted through the ducts.

U.S. Pat. No. 6,322,618 to the present inventors discloses an articulated duct arrangement having an external support, including a counterbalance and a gas spring for maintaining the duct in a position set by a user. This arrangement minimizes or replaces the use of friction fittings.

It is desirable to provide a system similar to that previously disclosed by the present inventors, but with various improvements to enhance ease of use and longevity.

SUMMARY OF THE INVENTION

An object of the invention is to provide a duct assembly positionable within a wide range, while holding a position, within a range of motion, without the need for friction fittings.

A further object of the invention is to provide improved duct assembly in which at least one duct segment is maintained in a position set by the user, by a means of a spring, preferrably a gas spring, associated with force reversal means to reverse the expansionary force of the spring into a contracting or pulling force, to counteract the force of gravity acting on the duct segments. A further object is to combine such a system, including a retractive force applying means, with a counterbalance arm to counteract the force of gravity acting on a second duct segment joined to the first segment.

The invention provides a ducting assembly which is preferably for collection and removal of material, although not limited to this application. The assembly comprises a plurality of flexibly joined duct sections and a duct support.

The invention comprises an adjustable duct assembly comprising: a base for mounting on a ceiling, wall or other fixed position and first and second elongate duct sections in end to end communicating relation. The first section is flexibly or pivotally joined to the base at a shoulder joint capable of a pivotal swinging rotation (first axis) preferrably also rotation about the axis of the duct (second axis). The first and second sections are flexibly or pivotally joined at an elbow joint. The base, first duct section and second section are joined in a manner in which permits rotation similar to that of a human arm. Namely, the shoulder joint preferrably permits rotation about two axes, while the elbow joint permits rotation about a single axis to permit a folding motion of the duct sections. It will be seen that the shoulder joint may also permit rotation about only a single axis to provide for a folding motion; however it is desirable to also provide for rotation of the duct assembly along its elongate axis at the shoulder joint. An external framework joins together the base and duct sections to permit rotation of the shoulder and elbow joints. Preferably the external framework joining the base with the first duct section, and the framework joining the first and second sections together, is aligned such that a folding motion of the assembly is provided, on a single vertical plane. A counterweight is joined to the second duct section for counterbalancing the rotation of the second section. Retractive force-applying means connect the base and first section to counteract the force of gravity acting on the assembly.

The retraction means include a spring means (i.e. an air spring, coil spring or other like means) for exerting a spreading, i.e. expansionary force tending to urge the ends of the spring apart, mounted to the external framework generally parallel to one of the duct sections. Force reversal means are provided for reversing the normal direction of force of the spring means. The force reversal means comprises first and second links extending around the spring means for converting the normal expansionary force thereof into a retractive force. A first of the links is pivotally mounted to the base and the second link is pivotally mounted to the first duct section, preferrably at a position at or adjacent to an end opposed to the base. Thus, each duct section is linked directly to an end of the gas opposed to the duct section. Preferably, the spring means is a gas spring, and more preferably dual gas springs.

The counterweight may comprise a counterbalance arm mounted to an arm support fixedly mounted to said second duct section.

The first end of the retraction means (or retractor) is preferably supported in a position generally parallel to and displaced from the adjacent first (proximal) duct section. This positioning increases the leverage which may be applied by the retractor. For example, one end of the retractor may be mounted to a scissors-like truss which positions the mount adjacent to the axis of rotation of the shoulder joint, but spaced apart therefrom. The truss comprises first and second arms pivotally jointed together, said first arm being pivotally mounted to the base and the second arm being pivotally mounted to the first external duct support.

A second mount at the opposed end of the retractor may be provided on an arm extending from the opposed end of the same (proximal) duct section.

The counterweight and retraction means are preferably arranged to maintain the duct in a selected position without the aid of a friction joint, within a range of the first duct section being positionable between a substantially vertical position and about 45 degrees below the horizontal, and the second duct section being rotatable about substantially a 360 degree arc relative to the first duct section.

Various connection means may be provided to link the duct sections, and the duct support, for example flexible duct sections. The distal end of the ducts should terminate in a hood or cowling. The system may include a universal flexible section connecting the hood and the first (distal) duct section, for rotational and pivotal movement of said hood relative to said first duct section.

DETAILED DESCRIPTION OF THE PREFERRED EMBODIMENTS

The embodiments of the adjustable duct assembly illustrated in FIGS. 1 to 9 includes two duct sections comprising a first duct section 12, defined here as the "proximal" section, and a second, distal duct section 10 in end-to-end relationship, and also includes a duct support comprising two external elongate arms 14 and 16, pivotally connected by a pivot joint at 18.

Figure 1:
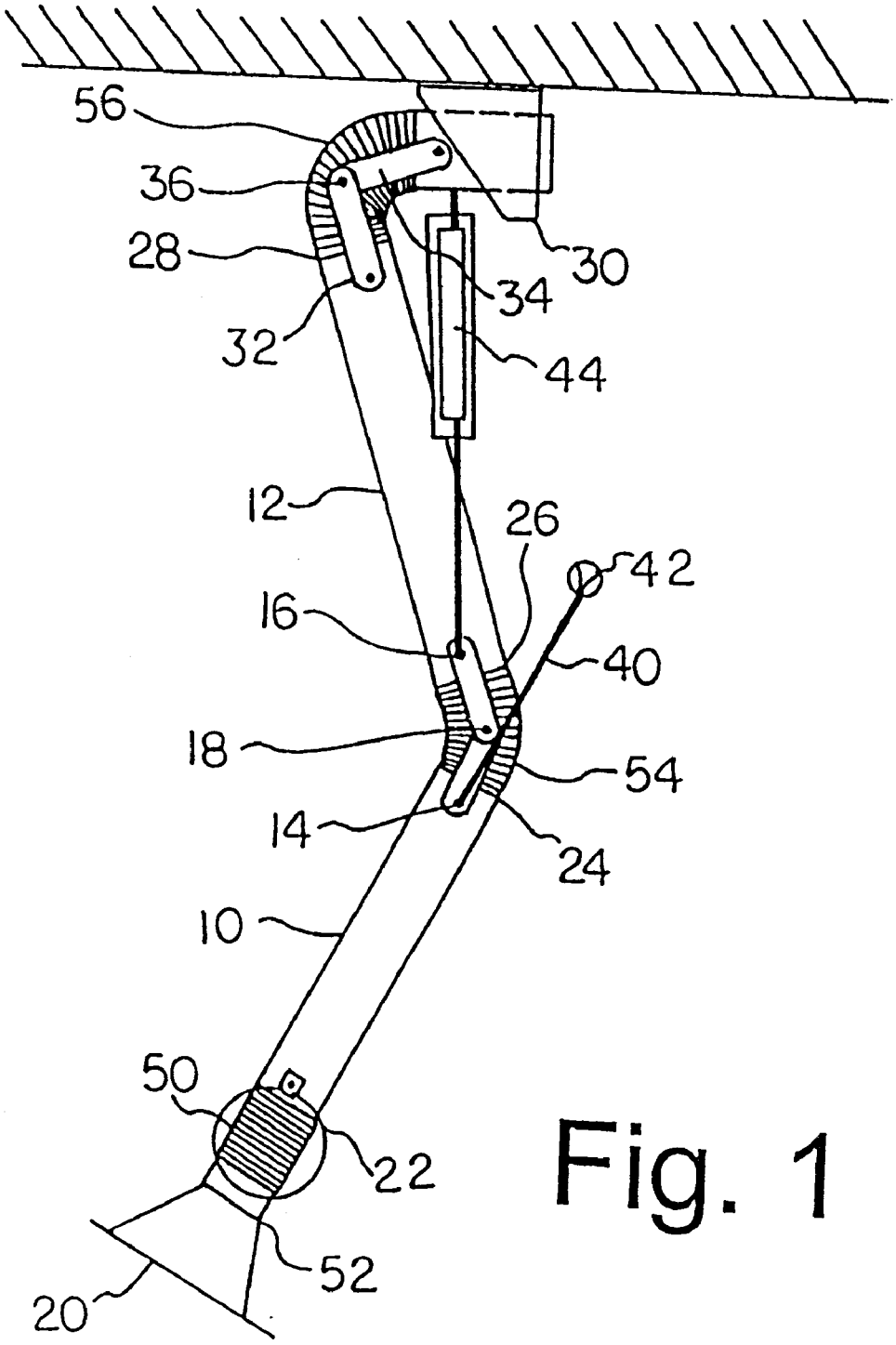
FIG. 1 is a side elevation of one embodiment of the present invention.

The assembly may be ceiling-mounted, as shown in FIG. 1. In this configuration, the assembly is rotatable about several axes. In particular, several flexible duct sections 50, 54 and 56 each provide pivotal movement about a horizontal axis to permit folding of the assembly, and the structure may be rotated about a vertical axis. Although the invention is described in detail herein by reference to a ceiling-mounted arrangement, this is not intended to limit the scope of the invention and the assembly may with suitable modifications be mounted on eg. a vertical wall or elsewhere.

The second duct section 10 has a collection inlet 20 attached to its inlet end 22 and is attached to arm 14 at the outlet end 24. The first duct section 12 is attached at its inlet end 26 to arm 16 and at its outlet end 28 is attached to a base of mounting support 30, in this example by a second pair of elongate arms 32 and 34 pivotally connected at 36. The support 30 communicates internally with the first section 12 and directs airflow from the ducts to eg. a filter, a fan or a vent. The support 30 is rotatable relative to its substrate e.g. a wall or ceiling to which the base is attached, thus permitting rotation of the duct assemble about a first axis corresponding generally with the axis of the duct sections 10, 12 when fully extended.

The support or base 30 is fixedly mounted to a surface such as a ceiling or wall, with a suitable connection means to rigidly fasten the assembly without danger of loosening or disconnection. The base 30 communicates internally with downstream components such as a filter, fan, vent etc. in a conventional manner. The flexible duct section 56, in combination with the base 30, provides an effective "shoulder" type joint, in which rotational movement is provided by the base 30, and pivotal folding movement about an axis transverse thereto, is provided by the flexible duct section 56 and the associated folding arm structure 32, 34 and 36. The pivot joints 18 and 36 are aligned and parallel, such that the shoulder and elbow joints of the duct assembly are aligned to permit folding movement of the assembly within a single vertical plane.

Rigidly attached to the arm 14 is a counterweight arm 40 which extends from the arm 14 beyond the pivot "elbow" joint 18. At the outer end of the arm 40 is a weight 42.

The counterweight arm 40 is rigidly joined to the arm 14, which in turn is rigidly joined to the distal duct section 10. Hence, the counterweight arm 40 provides a force acting on the duct section 10 to counteract gravity acting on the section 10. Extending between the arm 16 and the support 30 is a tensioning means 44, described in detail below. The tensioning means 44 acts to hold the proximate duct section 12 in any desired orientation but can be overridden to move the duct section. The weight 42 counterbalances the weight of the first duct section 10 and its associated parts, maintaining the duct section in a desired orientation but allowing easy movement of the duct section to any position.

The suction inlet 20, in the example in the form of a hood, is connected to the inlet end via flexible duct sections 50 extending from a tubular section 52 on the hood to the inlet end 22. Similarly the outlet end 24 of the duct section 10 is connected to the inlet end 26 of duct section 12 by a flexible duct section 54, comprising an "elbow" of the assembly. A further flexible duct section 56 comprising the duct "shoulder" joint connects the outlet end of the duct section 12 to the support 30. The elbow and shoulder joints permit rotation of the duct sections 10, 12 on about the second axes of rotation perpendicular to the first axis, and parallel to each other, i.e. free movement within a common vertical plane.

Figure 3:
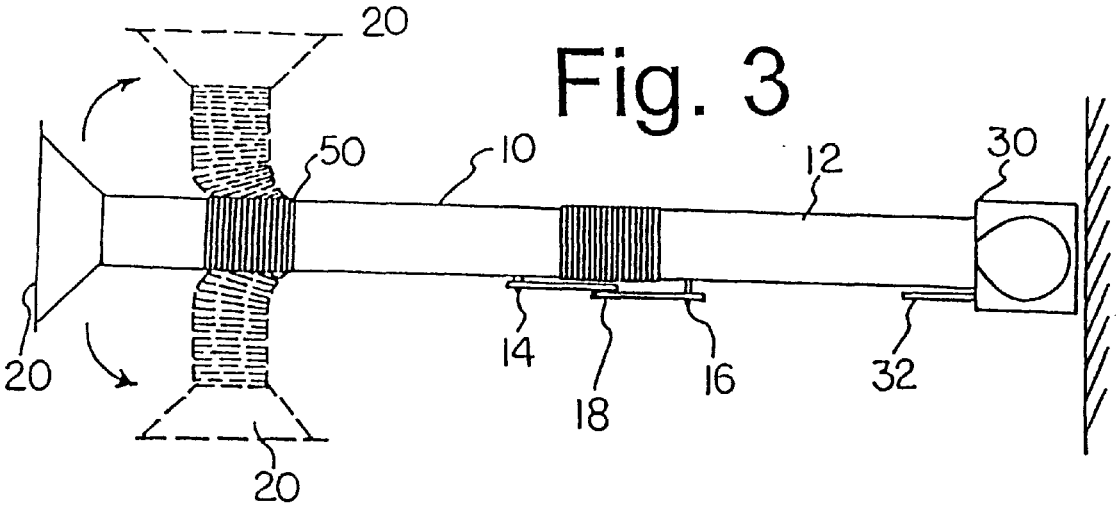
FIG. 3 is an elevational view, from the front, showing the collecting hood movement.
Figure 2:
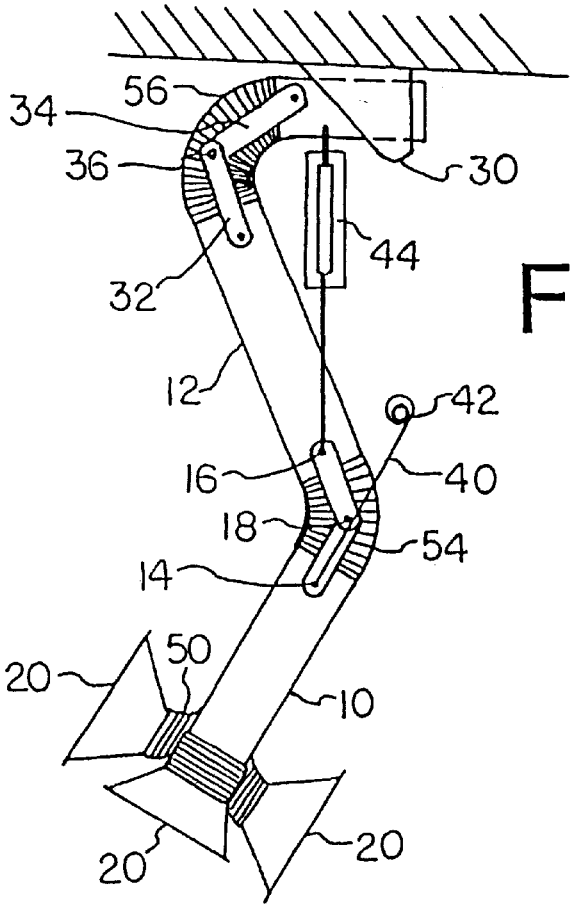
FIG. 2 is a view in the same direction as FIG. 1, showing the movement of a collecting hood.

The suction inlet hood 20 can be swivelled around to any desired direction, as seen in FIGS. 2 and 3. Also, if desired, the mounting support 30 can be pivotally mounted to permit swivelling of the entire assembly.

The invention permits the positioning of a collection inlet in almost any desired position, being freely and easily moved but at the same time, being held firmly in any set position. No friction joints exist, thus providing reduced wear and other problems. The support structures, the arms 14 and 16, arms 32 and 34, the counterweights 40 and 42 and gas spring 44 are all external to the duct sections and therefore do not interfere with the air flow.

The collected air and other material can be exhausted to the atmosphere, through a filter system for example, or can be filtered and treated, with the air recycled.

The above description and the drawings relate to a particular development which is capable of modification. For example, it is possible to insert a third duct section between the second duct section 12 and the support mounting 30, with a pivotal connection between them as is between duct sections 10 and 12, and with a further counterbalance weight as at 40 and 42.

Figure 4:
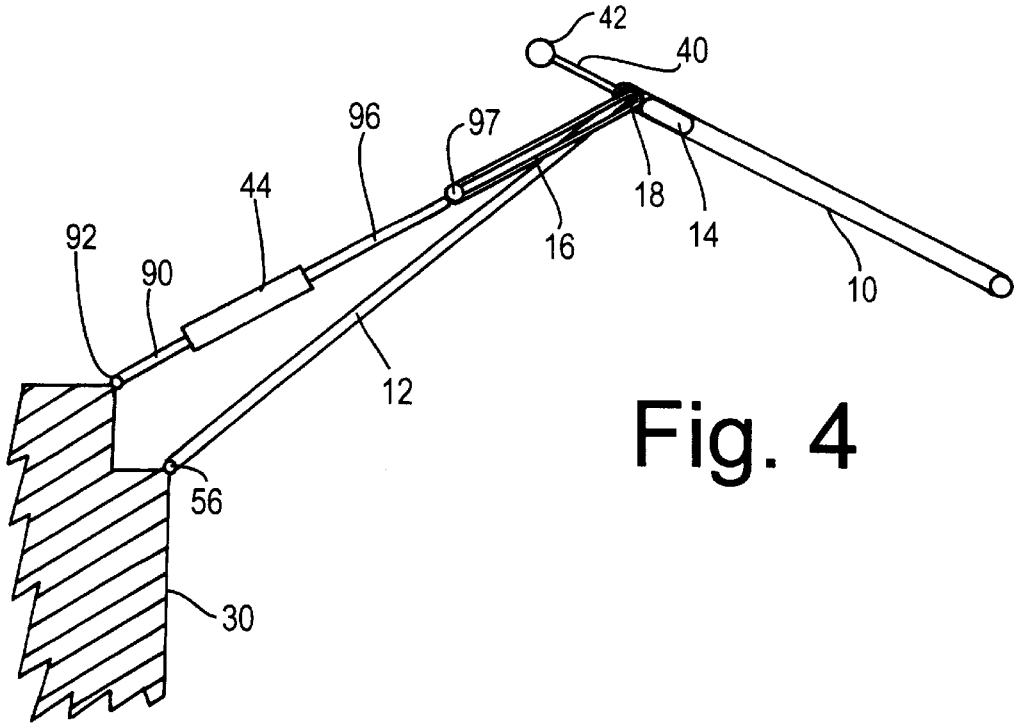
FIG. 4 is a schematic view of the duct assembly.
Figure 5:
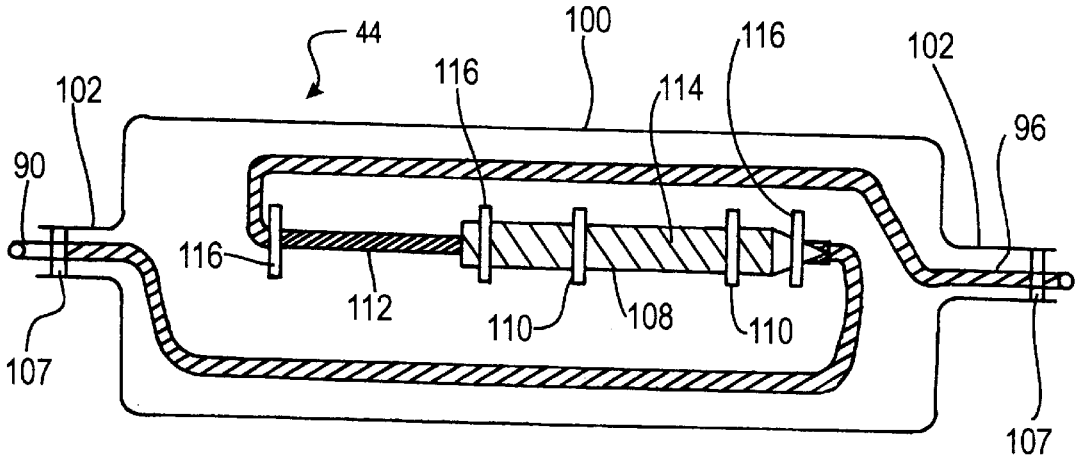
FIG. 5 is a schematic side elevation view of the tensioning portion of the duct assembly.

The tensioning means 44 and associated duct components are shown schematically in FIGS. 4 and 5. The distal duct section 10 and its associated counterweight arrangement 40, 42 are arranged such that the center of gravity of the combined elements coincides closely with the elbowjoint 18. For this purpose, the length of arm 40 and the weight of counterweight 42 are selected to counterbalance the force exerted by the duct section 10 and all components distal thereto. There is little need to make any adjustment during regular usage of the tensioning means 44, as positioning of the duct assembly in any normal position within a usable range of positions, requires a generally constant tensioning force for maintaining the assembly in its position.

Figure 8:
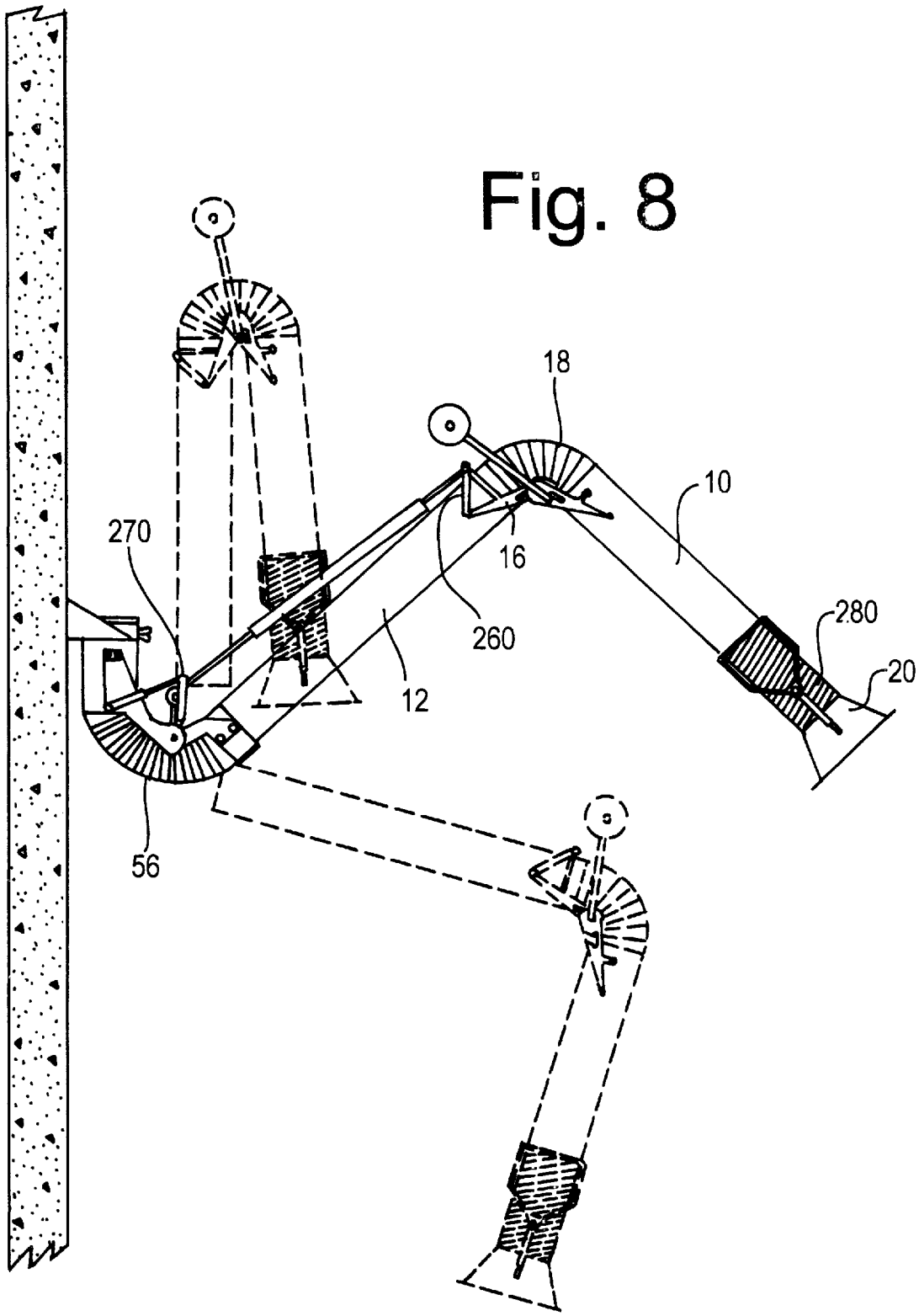
FIG. 8 is a side elevational view of the duct assembly, showing in dotted lines various positions of the assembly.
Figure 9:
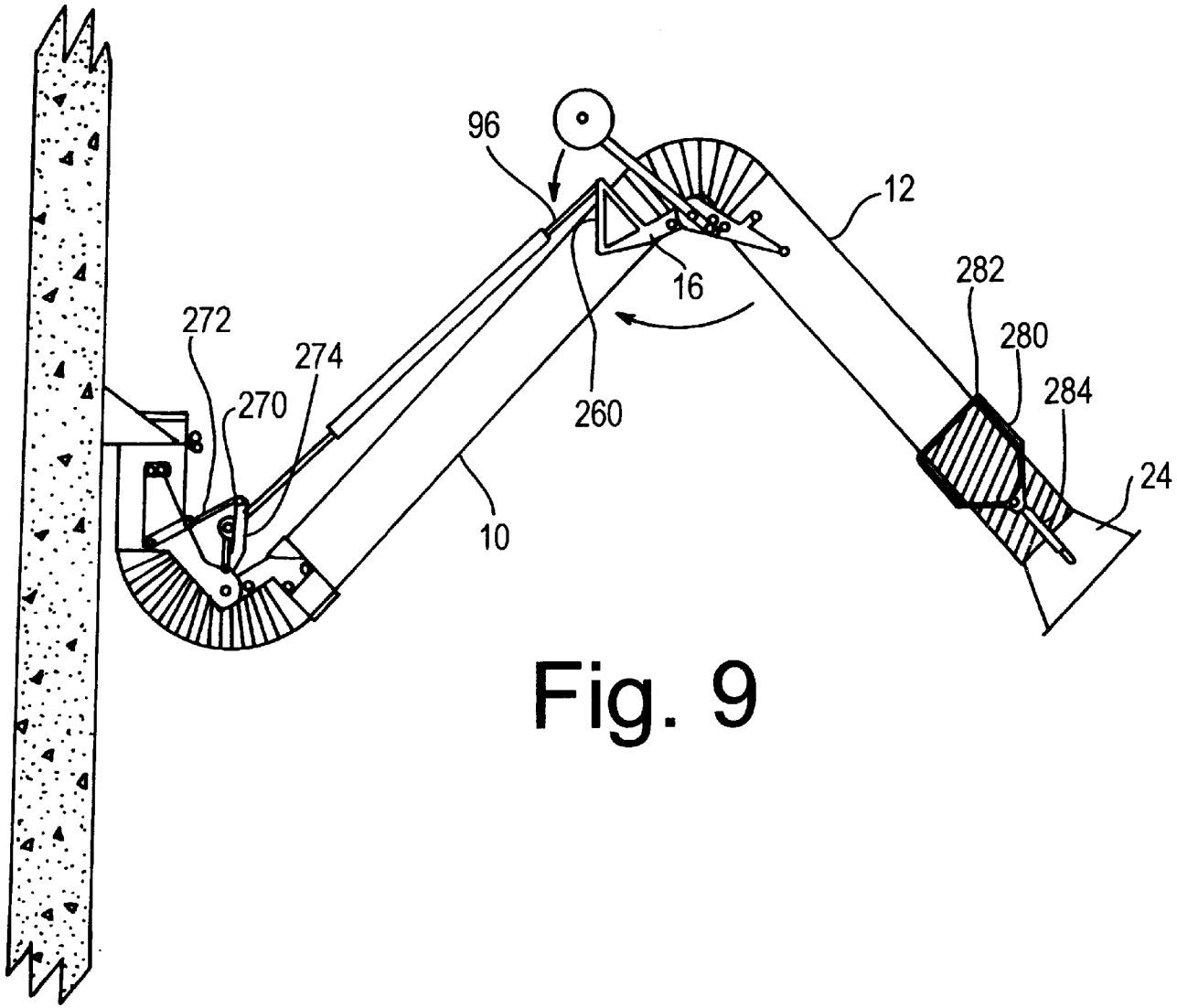
FIG. 9 is a further side elevational view of the duct assembly, showing the full range of motion of the elbow joint thereof.

The range of motion permitted by the tensioning means 44 and its associated support structures, permits folding of the assembly within a vertical plane at the shoulder joint 56, within an arc between a substantially vertical position and approximately 45 degrees below the horizontal, as shown in FIG. 8. The elbowjoint 18 has freedom of rotation about the vertical plane of substantially 360 degrees, as shown in FIG. 9. The duct sections 10 and 12 may be any convenient length. By way of a non-limiting example, the total duct length when fully linearly extended may range between 5 and 15 feet, with the first section 12 being between 15 inches and 64 inches. The second section 12 may range in length between 32 inches and 82 inches. Conveniently, the counterweight 42 may have a weight of approximately 1 kilogram, although this is a non-limiting example.

The tensioning means 44 is illustrated schematically in FIG. 5, which shows an internal view. The tensioning means 44 is connected via a first connecting rod 90 to the support 30 via a pivotable mount 92, which permits rotation of the rod 90 relative to the support 30. A second connecting rod 96 connects an opposed end of tension means 44 with the arm 16 of the duct support, via pivot mount 97. As will be seen from FIG. 1, a tensioning force applied to arm 16 has the effect of drawing the proximal duct section 12 inwardly towards the support 30, i.e. an inward folding. This force exerted by the tensioning means counteracts the force of gravity acting on the duct assembly.

The tensioning means 44 comprises a housing 100, having apertures 102 at either end to receive the connecting rods 90, 96. Conveniently, a bushing 107 surrounds the rods to minimize the entry of dust, etc. into the interior of the housing while permitting the rods 90, 96 to slide through the apertures 102. A gas spring 108 is disposed within the housing and is fixed in positioned by straps 110 which fasten the spring to a wall of the housing. The gas spring is of conventional design. That is, the spring exerts an expansionary force urging the ends of the spring away from each other, i.e. tending to push piston 112 outwardly from piston housing 114. The apertures 102 are aligned with each other and with the elongate axis of the gas spring. Within the interior of the housing 100, each of the connecting rods forms a loop around the gas spring. Thus, the first connecting rod 90 enters the housing via aperture 102 at an end of the housing adjacent to the support 30. However, rather than connecting to the end of the gas spring adjacent to the point of entry of the first connecting rod (the piston end in FIG. 5), the connecting rod 90 forms a loop around the gas spring, and joins with the gas spring at the piston housing 114. The second connecting rod 96 is similarly configured, to loop around the gas spring 108, and join with an end of the gas spring which is remote from the point of entry of the second rod 96. Although FIG. 5 illustrates each of the connecting rods 90, 96 joining with a respective end of the gas spring, it will be seen that rod 90 may join with any part of the housing 114 while the second rod 96 may join with any part of the piston 112 although connection with the terminal end is most desirable. As well, the relative position of the gas spring may be reversed within the housing 100. The effect of providing overlapping linkages 90 and 96 as described and illustrated herein, is to convert the normal expansion force exerted by the gas spring (i.e., tending to push the piston 112 outwardly from the piston housing) into a retractive force tending to draw the connecting rods 90 and 96 together, thereby tending to retract the duct assembly upwardly to counteract the downward pull of gravity.

The gas spring 108 may comprise a single spring. However, it is preferrable to provide dual side by side gas springs 108, the ends of which are linked together by linkage plates 116. The respective connecting rods 90 and 96 are welded or otherwise fastened to the connecting plates 116.

The one or two springs 108 may conveniently range in size from 6 inch diameter by 7 feet long, to 8 inch diameter times 15 feet long, by way of non-limiting examples. The force exerted by the spring or springs 108 is in the preferred example 150 pounds. As in known in the art of gas springs, the force has a ration factor of 1.4, meaning as the spring is compressed, the force exerted by the spring increases linearly up to 1.4 times the force when fully extended. The force expressed above of 150 pounds represents the fully extended force.

The gas spring 108 may be replaced with a conventional coil spring for exerting a compressive (i.e., elongating) force, or any other convenient spring or spring-like means for exerting a compressive force.

Figure 6:
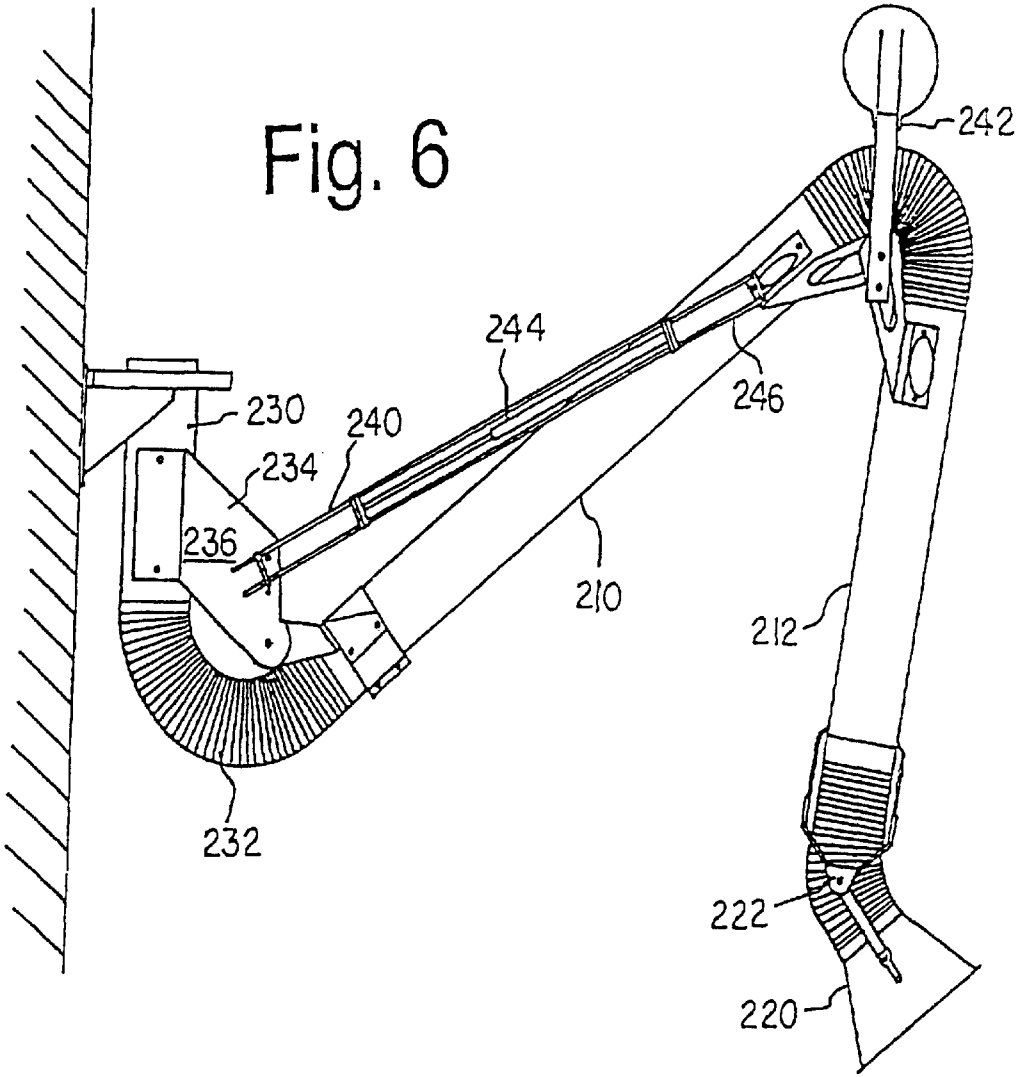
FIG. 6 is a side elevation of a second embodiment of the duct assembly.
Figure 7:
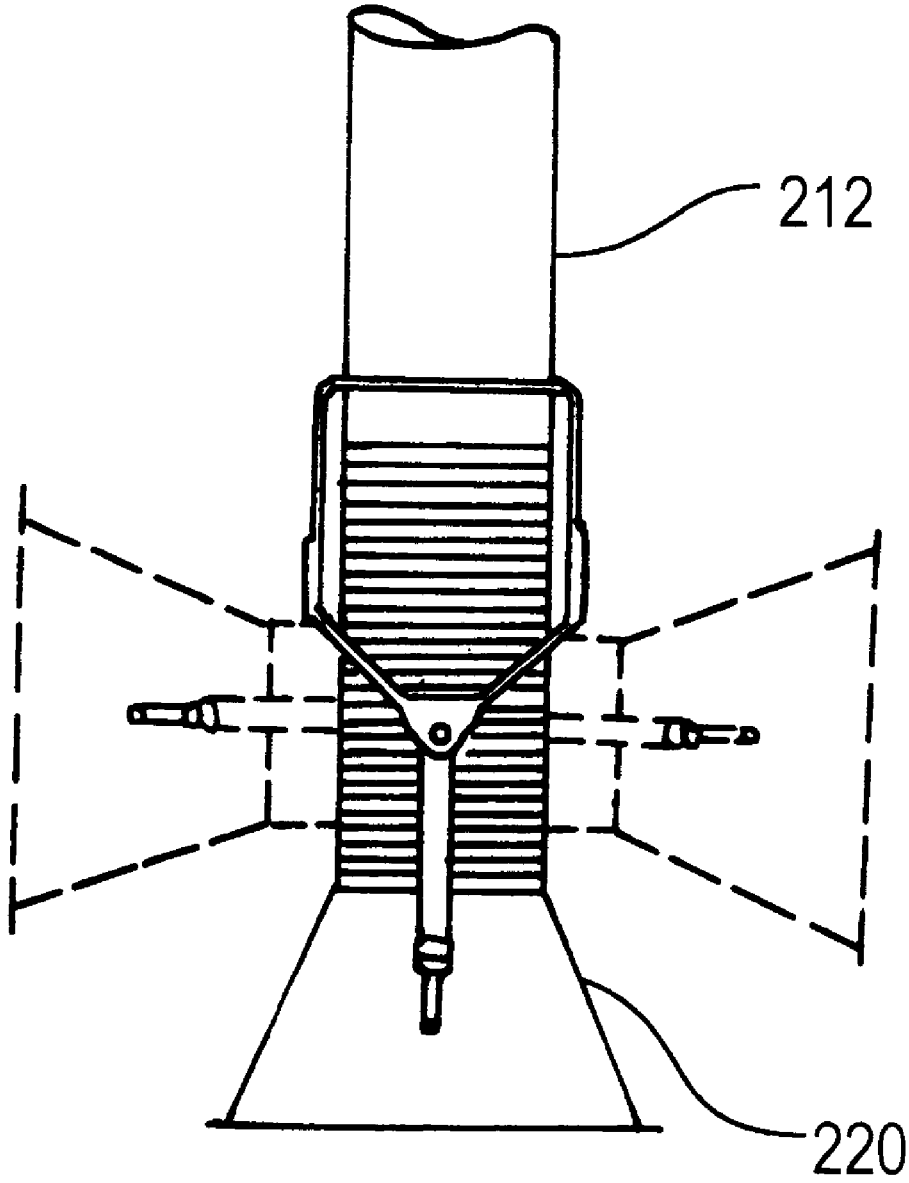
FIG. 7 shows a portion of the duct assembly of FIG. 6, showing the pivotal movement of the inlet.

FIGS. 6 and 7 illustrate a further embodiment of the duct assembly portion of the invention. In this version, the assembly is composed of first and second duct sections 210 and 212 as in the first embodiment. A collection inlet 220 forms the inlet end of the second duct section. As shown in FIG. 7, collection inlet 220 may be pivoted about an axis, within a range of approximately 180 degrees.

In this embodiment, a third duct section 230 is provided at the outlet end of the duct assembly, and joined to the first duct section 210 by flexible duct connection means 232. Also joining sections 230 and 210 is a hinged connection means 234, which forms a pivotal hinge means between the two sections. Connection means 234 includes a plate like member 236, fixedly mounted to third duct section 230. A retraction means 44, and associated mount and support means 246 joins the first and third duct sections, one end of the mount means 246 being fastened to the plate like member 236.

A counterweight 242 is engaged to the second duct section 212 in much the same manner as in the first embodiment.

FIGS. 8 and 9 illustrate further details of the external framework supporting the base and ducting sections. The arm 16 is provided with a triangular attachment structure 260, the apex of which pivotally joins with the connecting rod 96. A second triangular attachment member 270 is provided at the mounting support 30. One arm of the attachment 270 comprises a small gas spring or telescoping arm arrangement (without spring) 272. The second arm 274 is a fixed-length link. The respective arms 272 and 274 are pivotally joined respectively with the support 30 and the first elongate arm 32. The respective arms 272 and 274 are each pivotally joined at their base to their respective attachment points, thereby permitting a scissors-like freedom of movement thereto to accommodate folding of the duct assembly relative to the support 30.

The attachment structures 260 and 270 serve to position the tensioning means 44 in a position which is spaced apart from and generally parallel to the duct section 12. However, the tensioning means 44 and proximal duct section may converge somewhat towards one end or the other, as illustrated. This positioning maximizes the leverage that may be applied by the tensioning means on the duct assembly.

An external supporting structure 280 is provided to support the outlet and hood 26. The external support 280 comprises a yoke 282 joined to the second duct section 12, the apex of the yoke pivotally joined with a telescoping link 284. The yoke 282 is pivotally joined with the corresponding duct 12, thereby permitting pivotal movement of the hood 24 relative to the associated duct section 12.

Although the present invention has been described by way of detailed descriptions of preferred embodiments thereof, it will be understood that the full scope of the present invention is not limited to the detailed descriptions provided herein. Rather, the invention may include departures from and variations to the details of construction described herein. The full scope of the invention is defined in the entirety of this patent specification, including the claims.

We claim:

1. An adjustable duct assembly comprising:

a base for mounting on a ceiling or other fixed substrate;

first and second elongate duct sections in end to end communicating relation, said first section being pivotally joined with said base at a shoulder joint and said first and second sections being pivotally joined together at an elbow joint;

a hinged framework external to said duct sections joined with said base and duct sections to permit folding of the duct sections;

a counterweight joined to said second duct section for counterbalancing movement of said second section caused by gravity acting on said second section;

retraction means connecting said base and said first section to counteract the force of gravity acting on said assembly, said retraction means comprising a spring means for exerting an expansionary force and force reversal means for reversing the expansionary force of said spring means, said force reversal means comprising first and second links joined to opposed end regions of said springs means and extending around said spring means for converting the expansionary force thereof into a retractive force, said first and second links pivotally mounted to said base and said first duct section respectively.

2. An assembly as defined in claim 1, wherein said spring means comprises a gas spring assembly.

3. An assembly as defined in claim 2, wherein gas spring assembly comprises dual, side by side gas springs joined together with rigid links.

4. An assembly as defined in claim 1, wherein said counterweight comprises a counterbalance arm mounted to a portion of said framework mounted to said second duct section.

5. An assembly as defined in claim 1, wherein said hinged framework includes a support fixedly mounted to said first duct section and said second link is mounted to said support.

6. An assembly as defined in claim 1, wherein said framework includes first and second pivotally joined arms, each arm joined to a corresponding duct section.

7. An assembly as defined in claim 1, wherein said first and second links are each pivotally mounted to first and second mounts, said first mount being connected to said base and second mount being connected to an end of said first duct section opposed to said base, such that said retraction means is spaced apart from and generally parallel to said first duct section.

8. An assembly as defined in claim 7, wherein said second mount includes an arm pivotally joined to said elbow joint.

9. An assembly as defined in claim 7, wherein said first mount comprises a scissors truss comprising first and second arms pivotally jointed together at an apex, said first arm being pivotally mounted to said base and said second arm being pivotally mounted to a proximal end of said first external duct support.

10. An assembly as defined in claim 1, wherein said counterweight and retraction means are arranged to maintain said duct in a selected position without the aid of a friction joint, within a permitted range of motion of said first duct section between a substantially vertical position and substantially 45 degrees below the horizontal, and said second duct section being rotatable about substantially a 360 degree arc relative to said first duct section.

11. An adjustable duct assembly comprising:

a base for mounting on a ceiling or other fixed substrate;

first and second elongate duct sections in end to end communicating relation, said first section being pivotally joined with said base at a shoulder joint and said first and second sections being pivotally joined together at an elbow joint, for folding movement of said duct sections;

a framework external to said duct sections joined with said base and duct sections, said framework being hinged to permit folding of the duct sections;

a counterweight joined to said second duct section for counterbalancing the force of gravity acting on said second duct section;

retraction means connecting said base and said first section to counteract the force of gravity acting on said assembly, said retraction means comprising a spring means for exerting an expansionary force and force reversal means for reversing the expansionary force of said spring means, said force reversal means comprising first and second links joined to opposing end regions of said spring means and extending around said spring means for converting the expansionary force thereof into a retractive force, said first and second links pivotally mounted to said base and said first duct section respectively;

first and second mount means, said first mount means comprising first and second arm pivotally mounted together at an apex, said first arm being pivotally joined to base and said second arm being pivotally connected to said first duct section, and said first link being mounted to said first mount; said second mount comprising an arm pivotally joining said second link with said first duct section.

12. An assembly as defined in claim 11 wherein one of the arms of said first mount means is telescopically length adjustable.

13. An assembly as defined in claim 11, wherein said second mount means includes an arm pivotally joined to said assembly at said elbow joint.

14. An assembly as defined in claim 11, wherein said first and second mounts are arranged for holding said retraction means generally parallel to and displaced from said first duct section for increasing the leverage acting on said assembly by said retraction means.

* * * * *